US007517171B2

(12) United States Patent
Coats

(10) Patent No.: US 7,517,171 B2
(45) Date of Patent: Apr. 14, 2009

(54) POWERED BROOM SHIFT

(75) Inventor: Robert E. Coats, Sac City, IA (US)

(73) Assignee: GOMACO Corporation, a div. of Godbersen Smith Construction Co., Ida Grove, IA (US)

( * ) Notice: Subject to any disclaimer, the term of this patent is extended or adjusted under 35 U.S.C. 154(b) by 135 days.

(21) Appl. No.: 11/810,610

(22) Filed: Jun. 6, 2007

(65) Prior Publication Data

US 2007/0286679 A1 Dec. 13, 2007

Related U.S. Application Data

(60) Provisional application No. 60/811,490, filed on Jun. 7, 2006.

(51) Int. Cl.
*E01C 23/02* (2006.01)

(52) U.S. Cl. ..... 404/89; 404/93

(58) Field of Classification Search ..... 404/83–84.8, 404/89, 93, 94, 116
See application file for complete search history.

(56) References Cited

U.S. PATENT DOCUMENTS 3,605,579 A * 9/1971 Heltzel ..... 404/93
3,850,541 A * 11/1974 Baillet et al. ..... 404/114
4,318,631 A * 3/1982 Vickers ..... 404/93
6,497,531 B2 * 12/2002 Sipherd et al. ..... 404/111
7,121,761 B2 * 10/2006 Woodruff ..... 404/17

* cited by examiner

*Primary Examiner*—Raymond W Addie
(74) *Attorney, Agent, or Firm*—Suiter Swantz pc llo

(57) ABSTRACT

A machine for texturing a paved road surface on a skew includes a bridge rig spanning the paved road surface in a generally transverse orientation with relation to the generally longitudinal orientation of the paved road surface. The machine includes a carriage assembly, which is supported by the bridge rig for traveling along the bridge rig in its generally transverse orientation. The machine also includes a texturing element, such as a broom, or the like, which is connected to the carriage assembly for texturing the paved road surface as the carriage assembly moves along the bridge rig. By coordinating the movement of the texturing element with the movement of the carriage assembly, the paved road surface is textured on a skew with a transverse tining pattern while the frame of the machine remains square to the paved road surface.

20 Claims, 19 Drawing Sheets

POWERED BROOM SHIFT

CROSS-REFERENCE TO RELATED APPLICATIONS

The present application claims the benefit under 35 U.S.C. § 119(e) of U.S. Provisional Application Ser. No. 60/811,490, filed Jun. 7, 2006. Said U.S. Provisional Application Ser. No. 60/811,490 is herein incorporated by reference in its entirety.

FIELD OF THE INVENTION

The present invention generally relates to the field of paving, and more particularly to a texturing machine for transverse tining newly paved surfaces on a skew, such as for newly paved streets, highways, and the like.

BACKGROUND OF THE INVENTION

Oftentimes it is desirable to texture a newly paved surface, such as a freshly paved street, a freshly paved highway, or the like. Many times, the desired texture will include transverse tining (grooving) the newly paved surface on a skew, such as a on a 4:1 skew or on a 6:1 skew. Other means of accomplishing this skewed pattern have involved skewing an entire texture/cure machine to provide the desired result. For example, one prior technique involved skewing the frame of a texture/cure machine utilizing a secondary crawler track mount with a center pivot, with stop blocks and pinning means located at each crawler track. This configuration added length to the machine and required readjustment of the skewed frame for transport. Other disadvantages included tining up to headers, and utilizing a burlap drag attachment and/or a poly roller attachment.

Thus, it would be desirable to provide a machine for texturing a newly paved surface on a skew without affecting the rest of the texturing machine or its attachments.

SUMMARY OF THE INVENTION

Accordingly, the present invention is directed to apparatus and methods for texturing a paved surface on a skew by shifting the texturing element (e.g., a broom) front to rear and rear to front, in a sliding mount mechanism without affecting the rest of the texturing machine or its attachments.

A machine for texturing a paved road surface on a skew (i.e., at an angle relative to a line parallel to the generally longitudinal direction of the road surface) while the paved road surface is in a plastic state (i.e., a freshly paved road surface) includes a bridge rig for spanning the paved road surface. The bridge rig spans the paved road surface in a generally transverse orientation with relation to the generally longitudinal orientation of the paved road surface. The machine includes a transverse texturing assembly connected to the bridge rig. The transverse texturing assembly includes a carriage assembly, which is supported by the bridge rig for traveling along the bridge rig in its generally transverse orientation. The transverse texturing assembly also includes a texturing element, such as a broom, or the like, which is connected to the carriage assembly for texturing the paved road surface as the carriage assembly moves along the bridge rig.

The texturing element is translationally coupled with the undercarriage assembly for texturing the paved road surface. The texturing element is longitudinally aligned with the paved road surface for traveling in the generally longitudinal orientation of the paved road surface with respect to the carriage assembly. Thus, the texturing element is capable of forward and backward movement along the paved road surface in an orientation generally parallel to the direction of travel of the machine as it translates longitudinally with respect to the carriage assembly. By coordinating the longitudinal movement of the texturing element with the transverse movement of the carriage assembly, the paved road surface is textured on a skew with a transverse tining pattern (skew pattern) while the frame of the machine remains square to the paved road surface.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
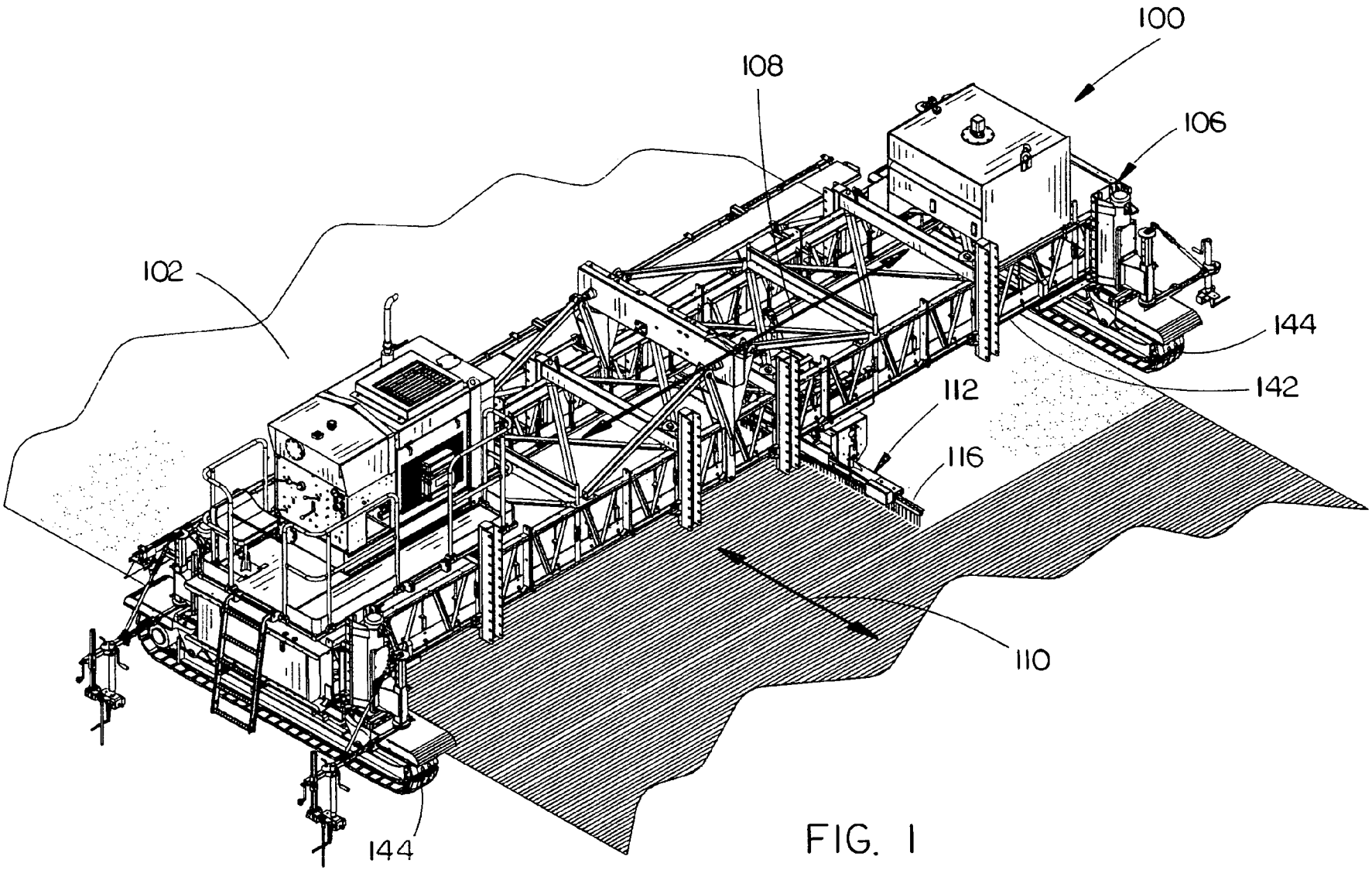
FIG. 1 is an isometric view illustrating a texturing/curing machine in accordance with an exemplary embodiment of the present invention, wherein the texturing/curing machine includes a transverse texturing assembly for texturing a paved road surface on a skew.
Figure 2:
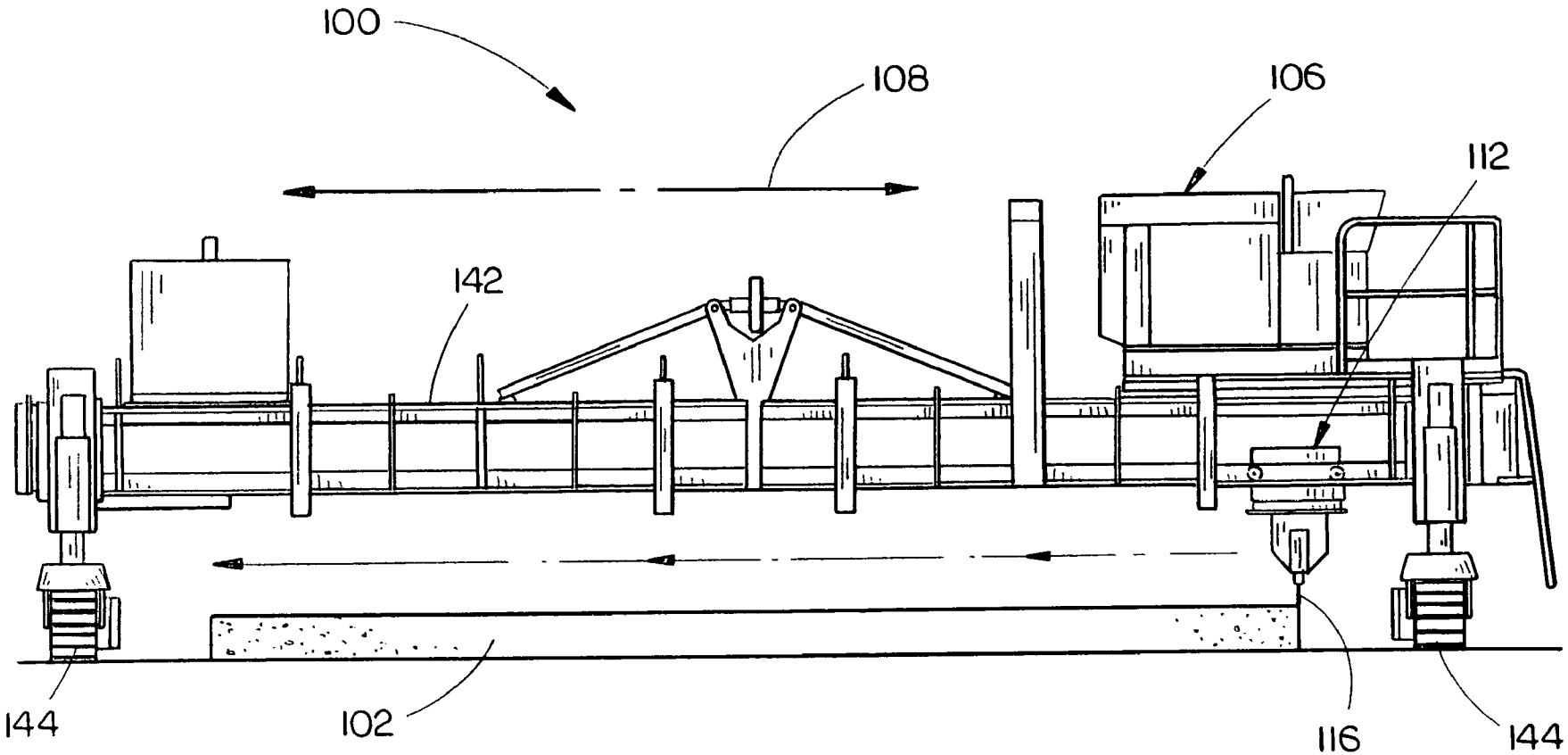
FIG. 2 is a front elevation view of the texturing/curing machine illustrated in FIG. 1, further illustrating the longitudinal translation of a texturing element across the paved road surface.
Figure 3:
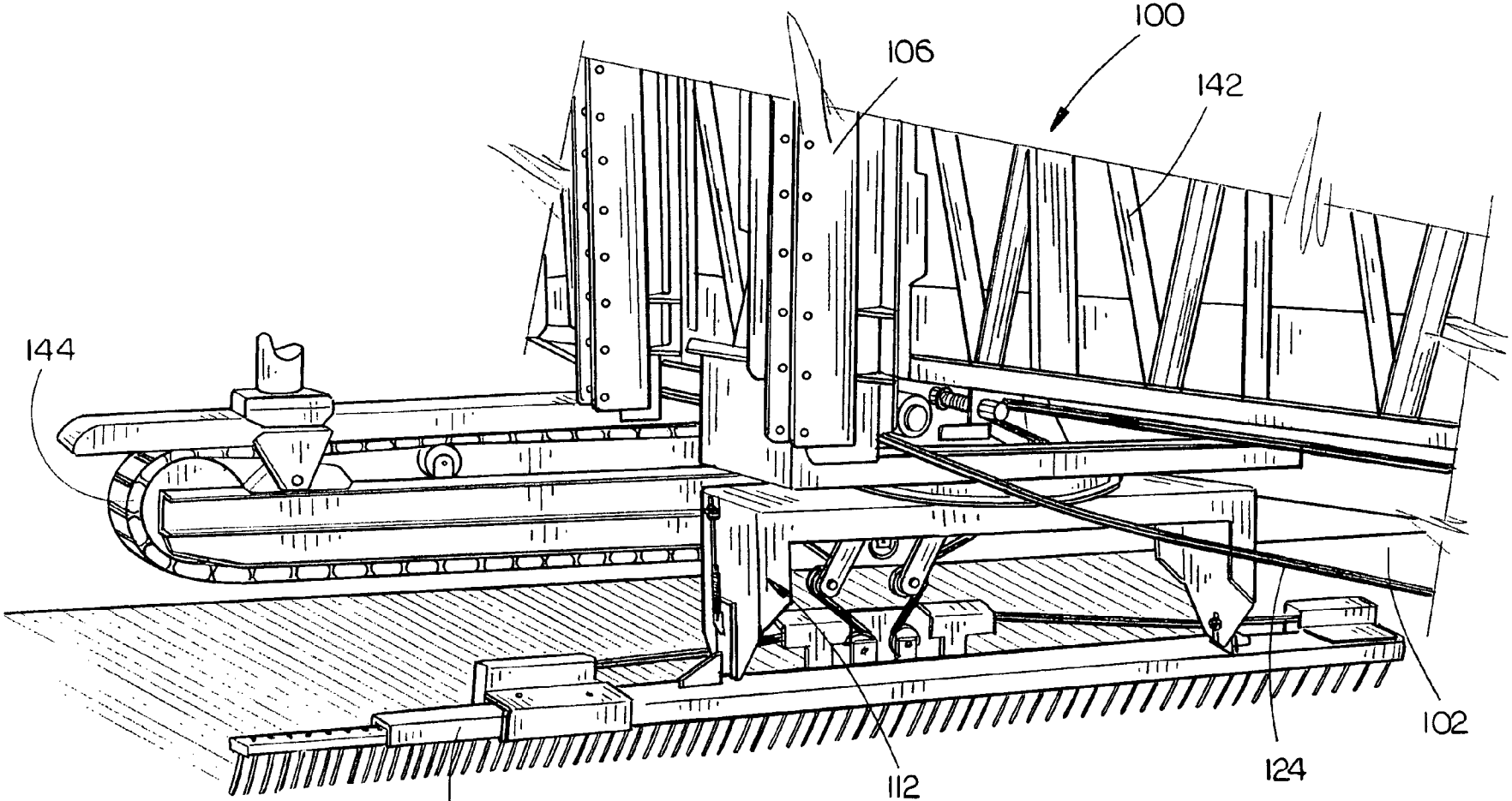
FIG. 3 is a partial perspective view of the texturing/curing machine illustrated in FIG. 1.
Figure 4:
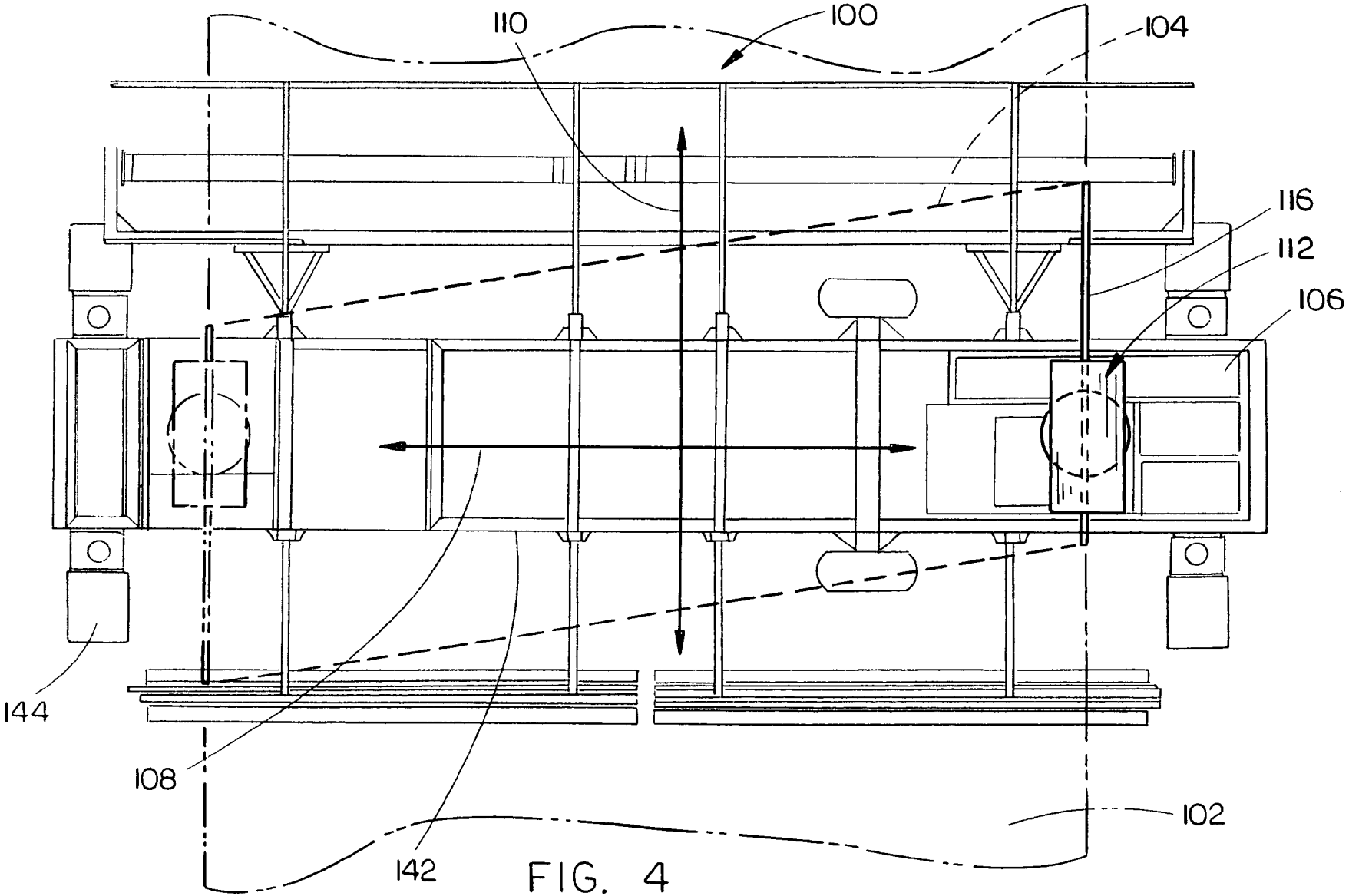
FIG. 4 is a plan view of the texturing/curing machine illustrated in FIG. 1, further illustrating the skew of the texturing element across the paved road surface.
Figure 5:
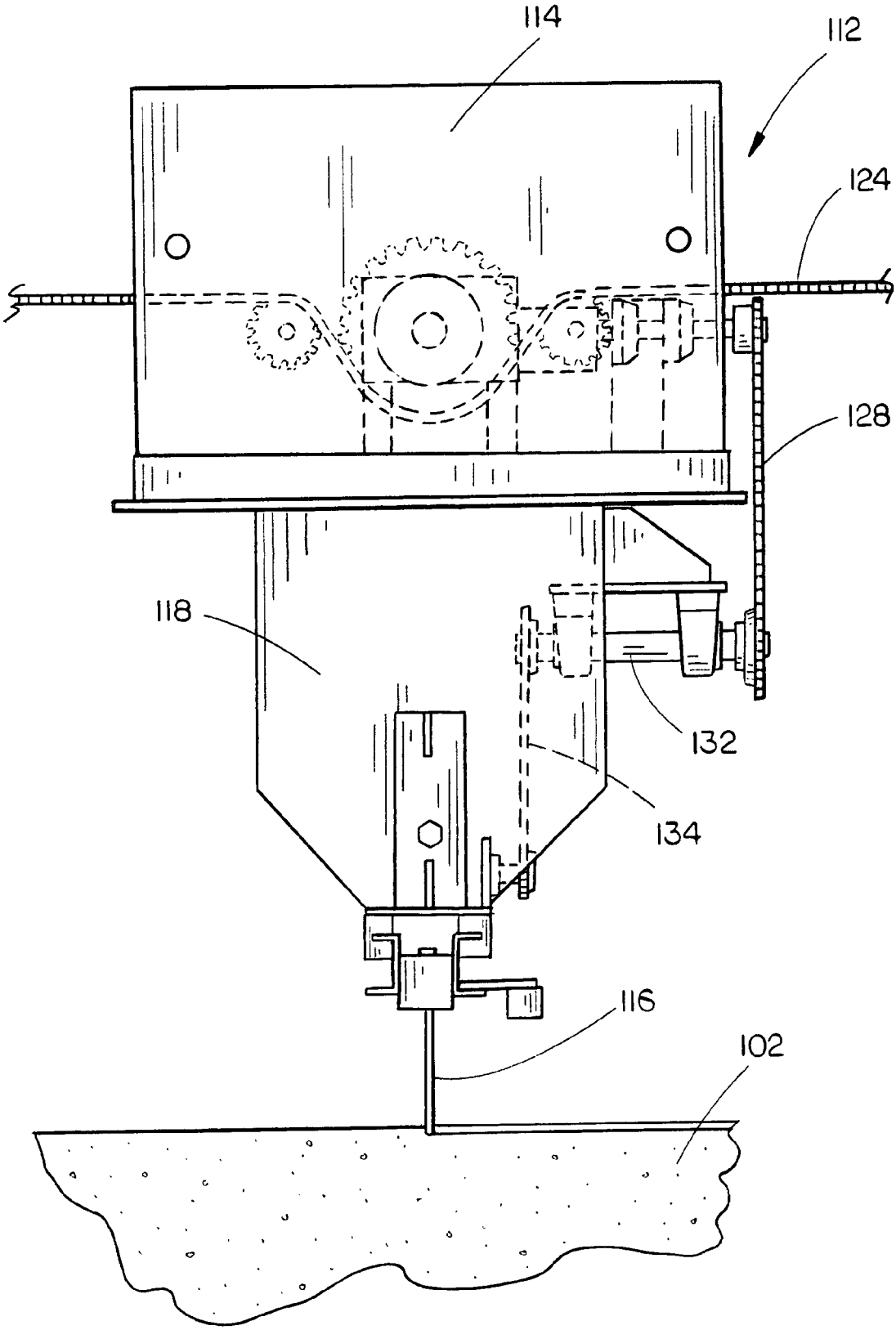
FIG. 5 is a front elevation view of a transverse texturing assembly for connecting with a texturing/curing machine in accordance with an exemplary embodiment of the present invention.
Figure 6:
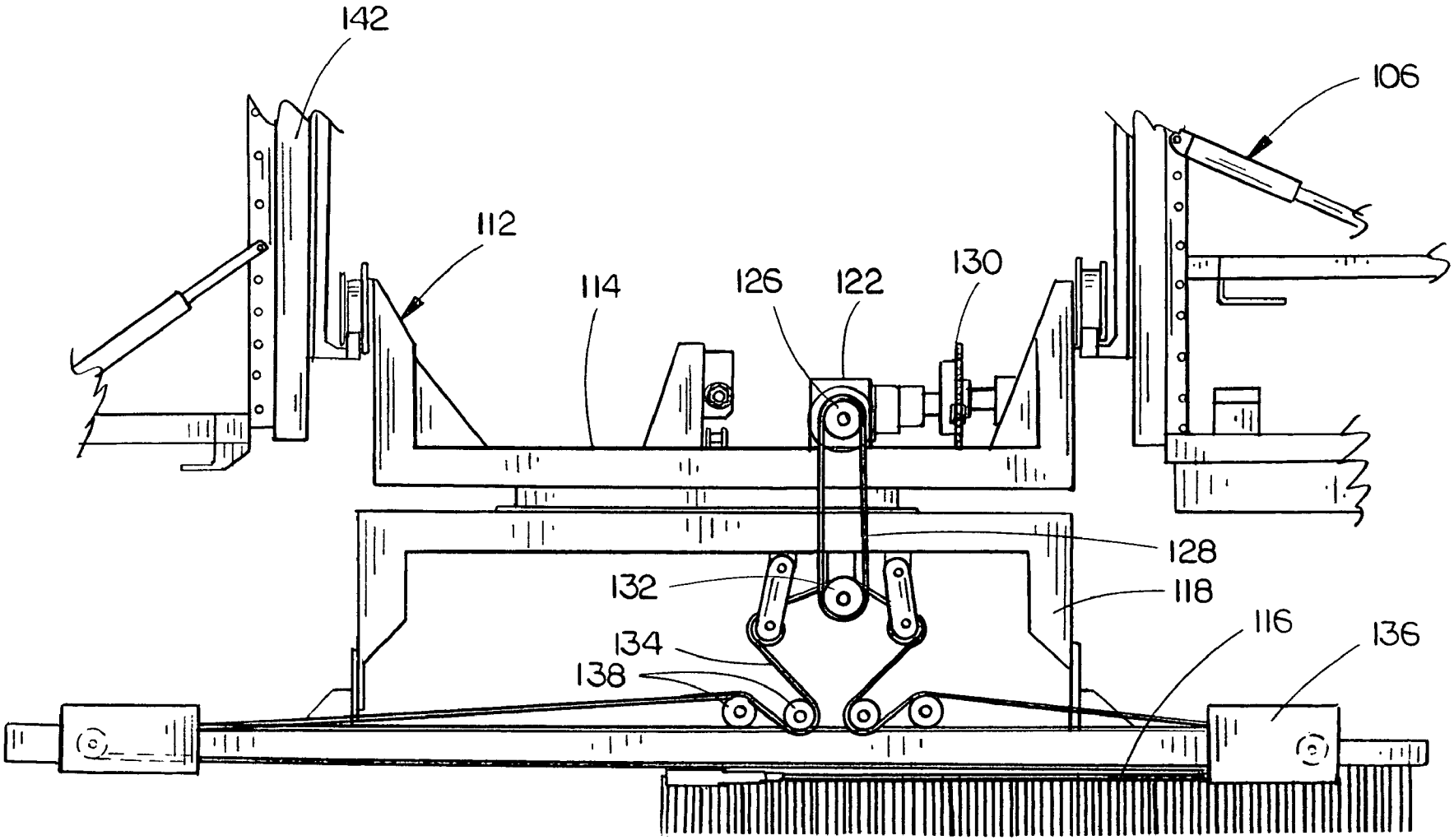
FIG. 6 is a side view of the transverse texturing assembly illustrated in FIG. 5, wherein the transverse texturing assembly is connected with the frame of a texturing/curing machine.
Figure 7:
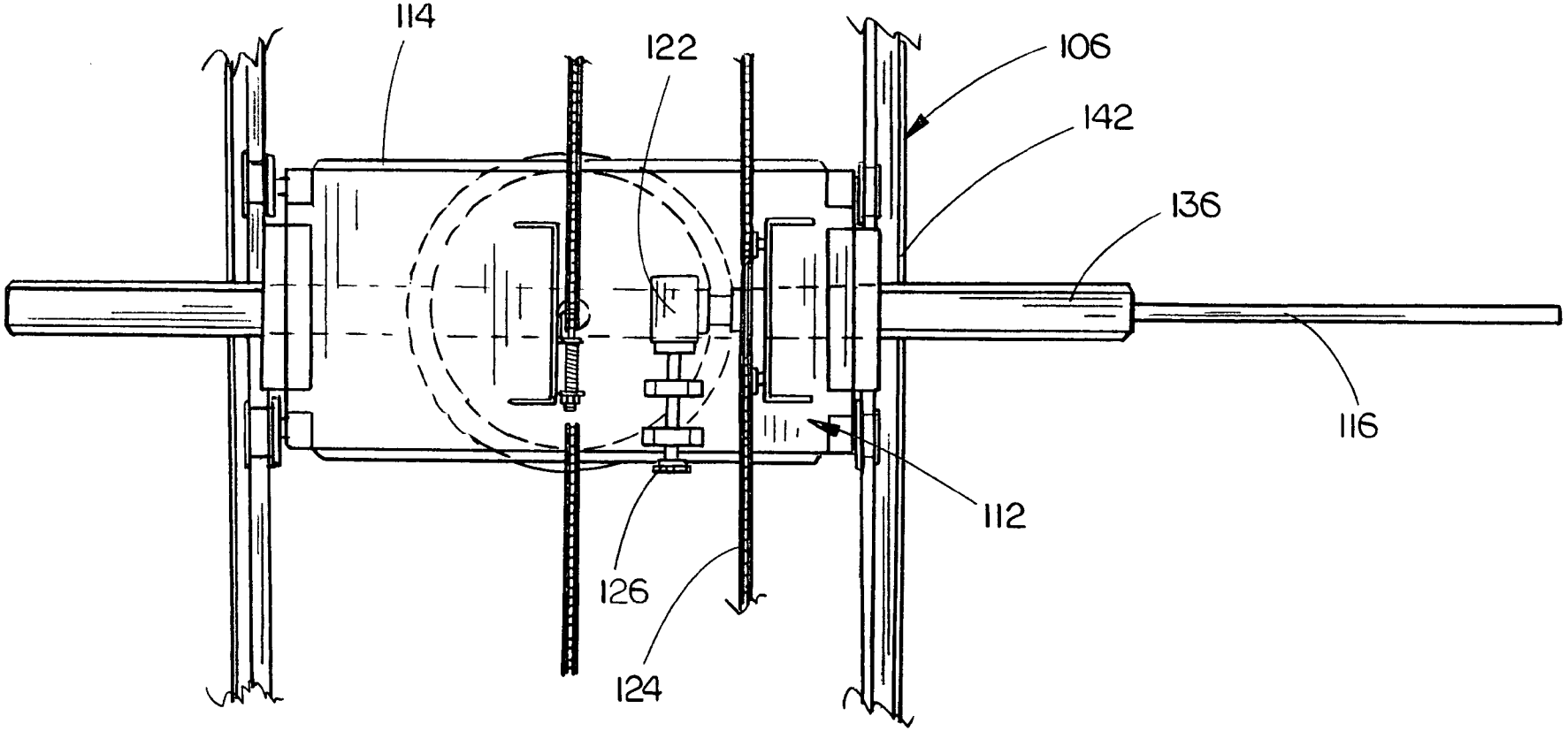
FIG. 7 is a plan view of the transverse texturing assembly illustrated in FIG. 5, wherein the transverse texturing assembly is connected with the frame of a texturing/curing machine.
Figure 8:
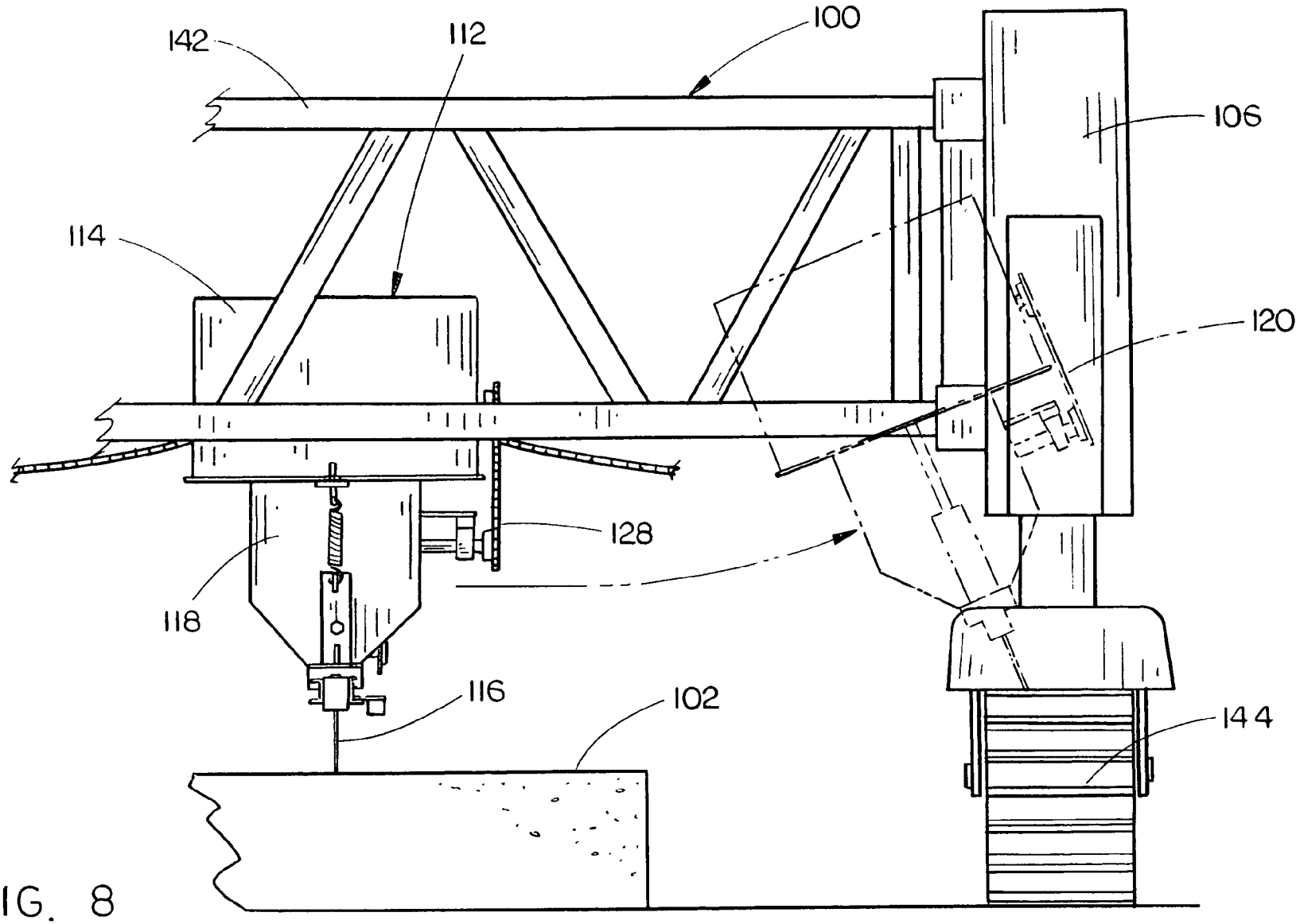
FIG. 8 is a front elevation view of the transverse texturing assembly illustrated in FIG. 5, wherein the transverse texturing assembly is connected with the frame of a texturing/curing machine, and the transverse texturing assembly is shown in phantom in a stowage position.
Figure 9:
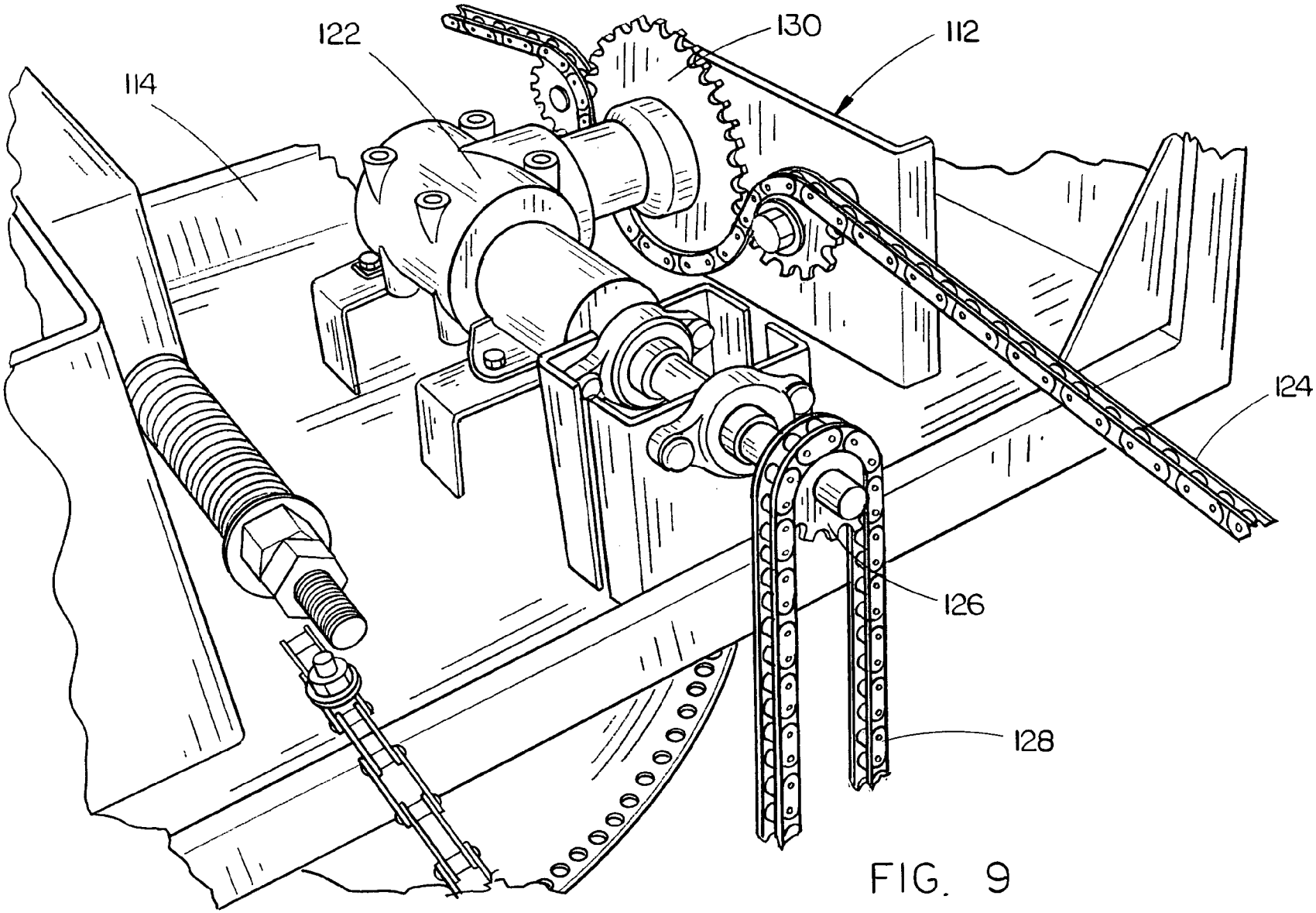
FIG. 9 is a partial perspective view of the transverse texturing assembly illustrated in FIG. 5.
Figure 10:
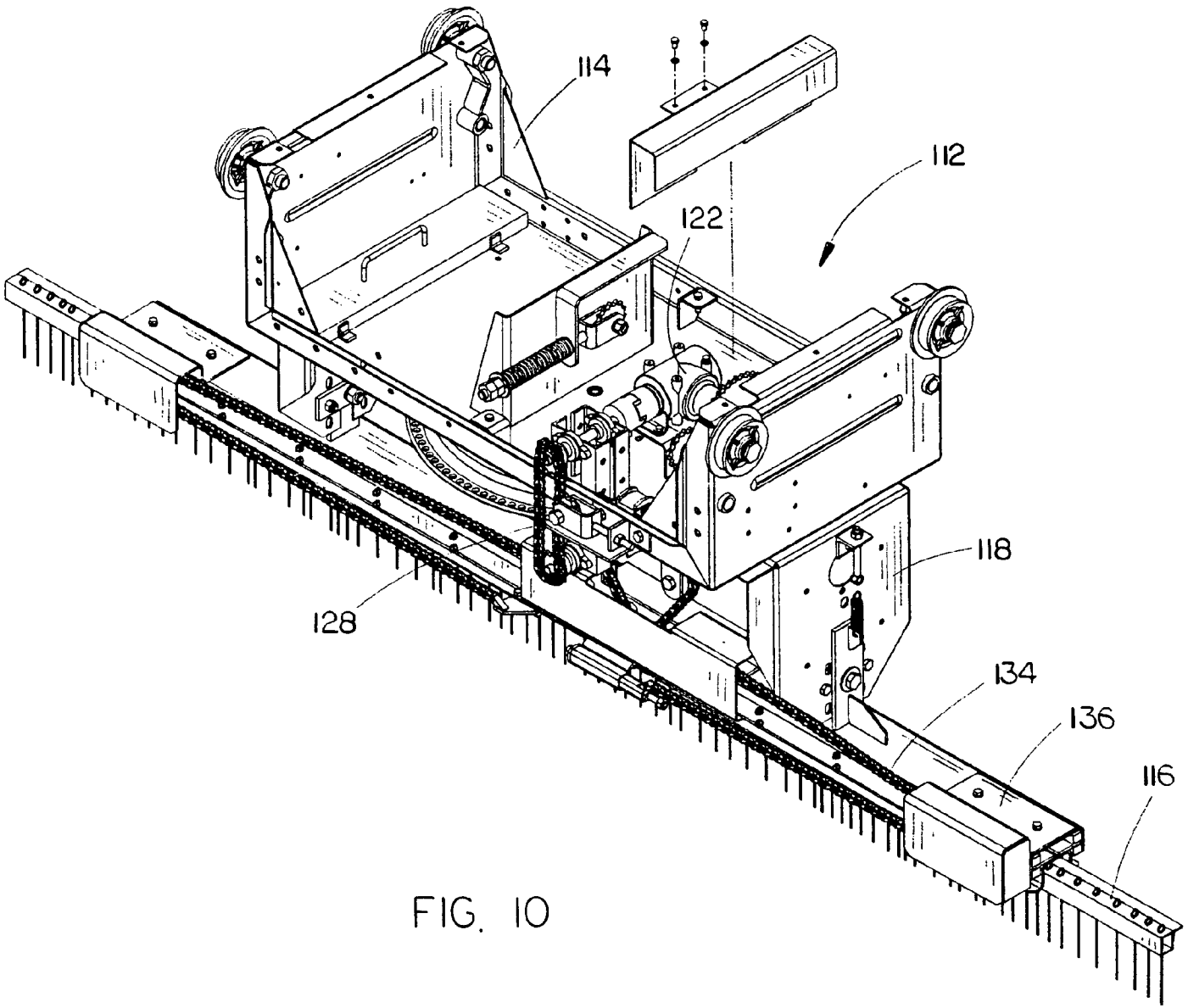
FIG. 10 is a partially exploded isometric view of the transverse texturing assembly illustrated in FIG. 5, wherein the transverse texturing assembly includes a carriage assembly and an undercarriage assembly, and wherein the undercarriage assembly includes a frame, an upper broom mount slide assembly, and a lower texture broom mount assembly.
Figure 11:
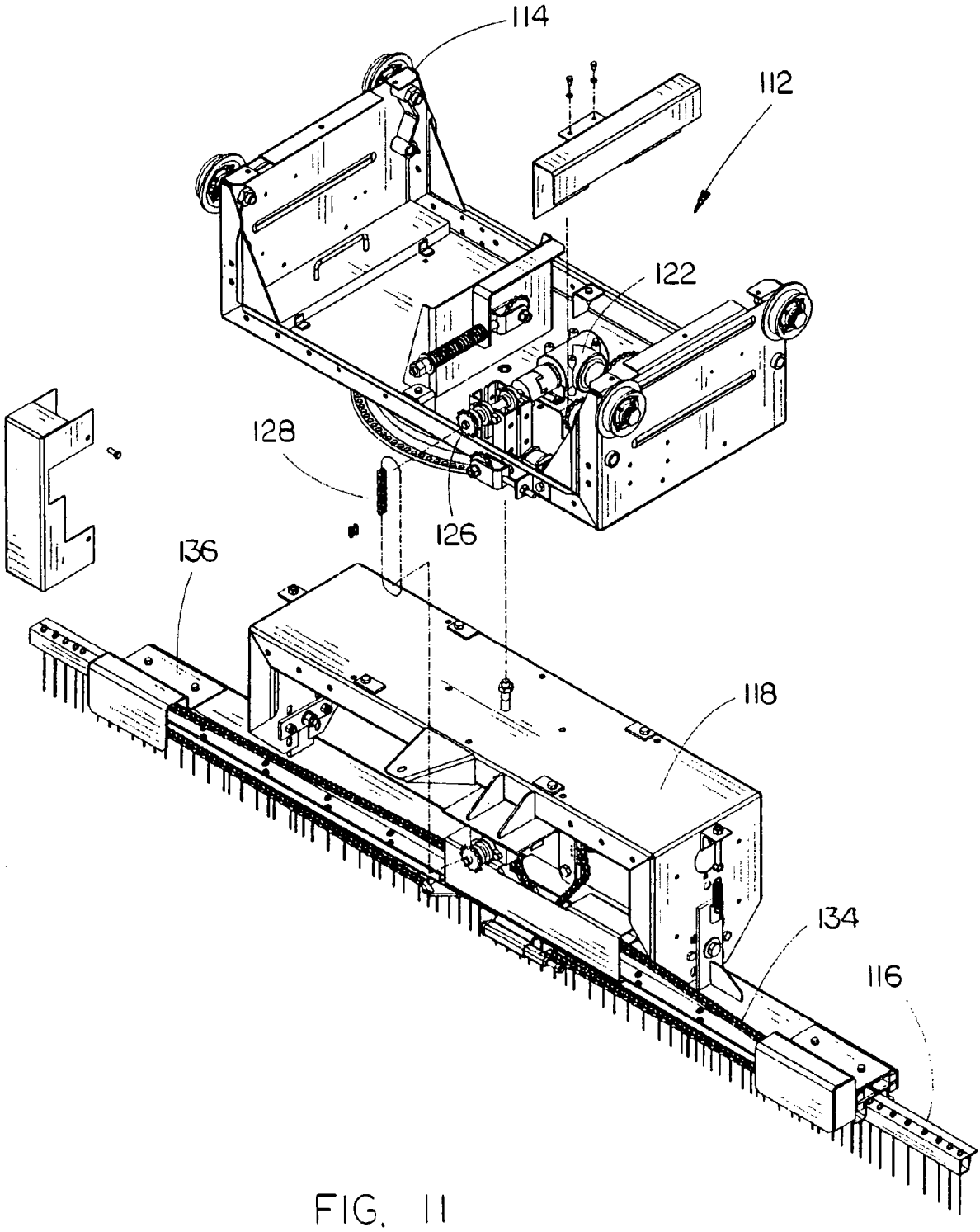
FIG. 11 is an exploded view of the transverse texturing assembly illustrated in FIG. 10.
Figure 12:
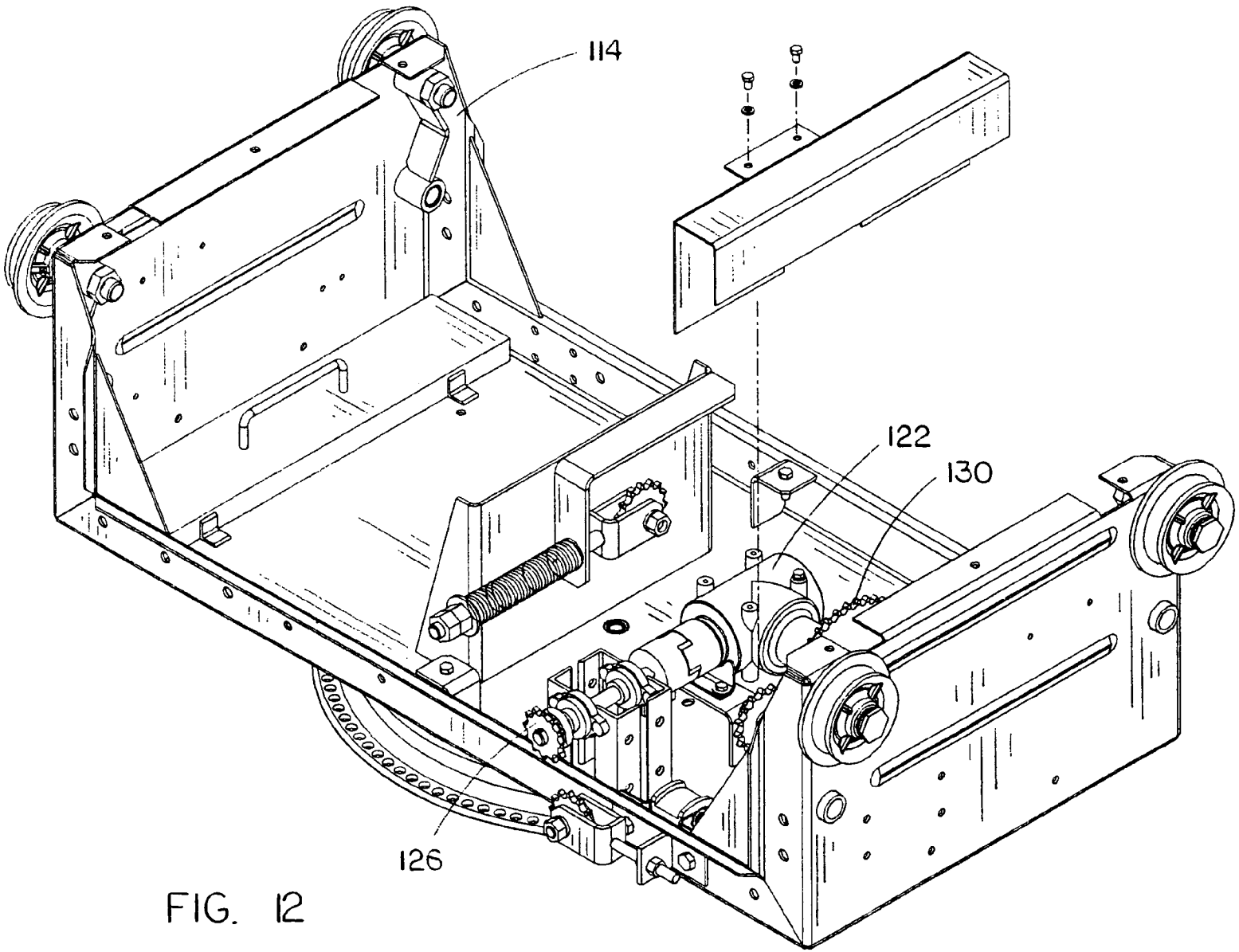
FIG. 12 is a partially exploded isometric view of the carriage assembly illustrated in FIG. 10.
Figure 13:
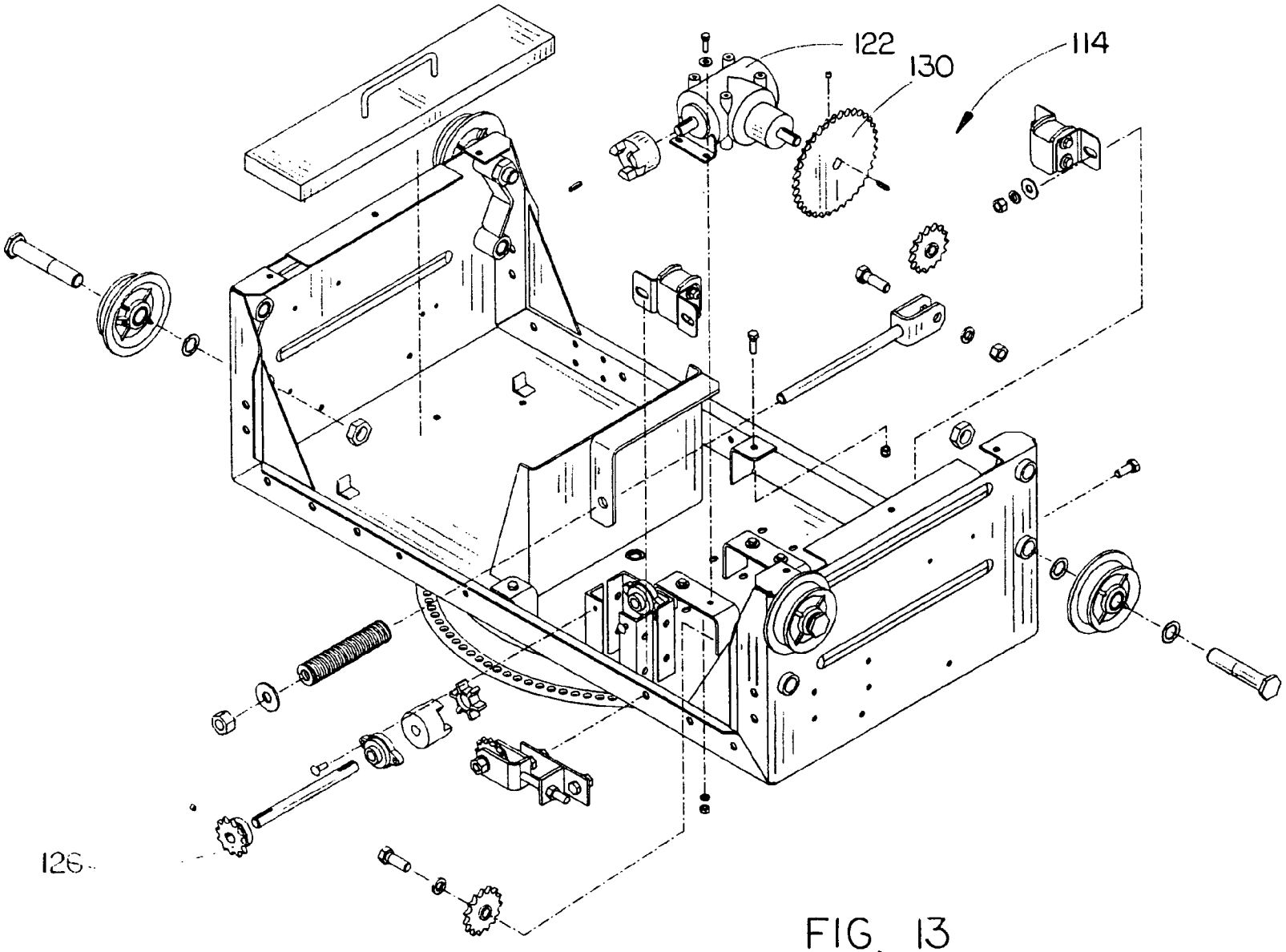
FIG. 13 is an exploded isometric view of the carriage assembly illustrated in FIG. 10.
Figure 14:
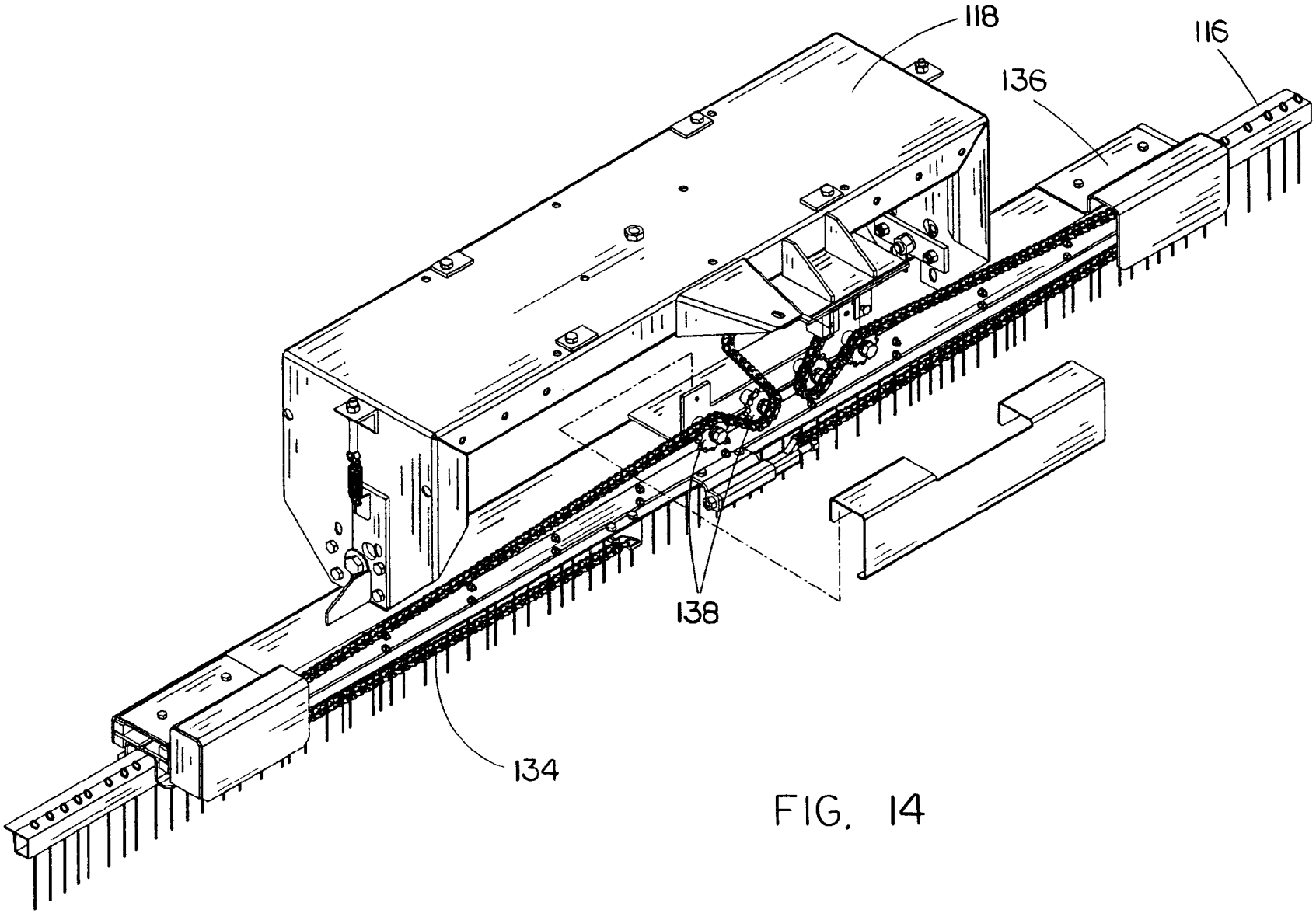
FIG. 14 is a partially exploded isometric view of the undercarriage assembly illustrated in FIG. 10.
Figure 15:
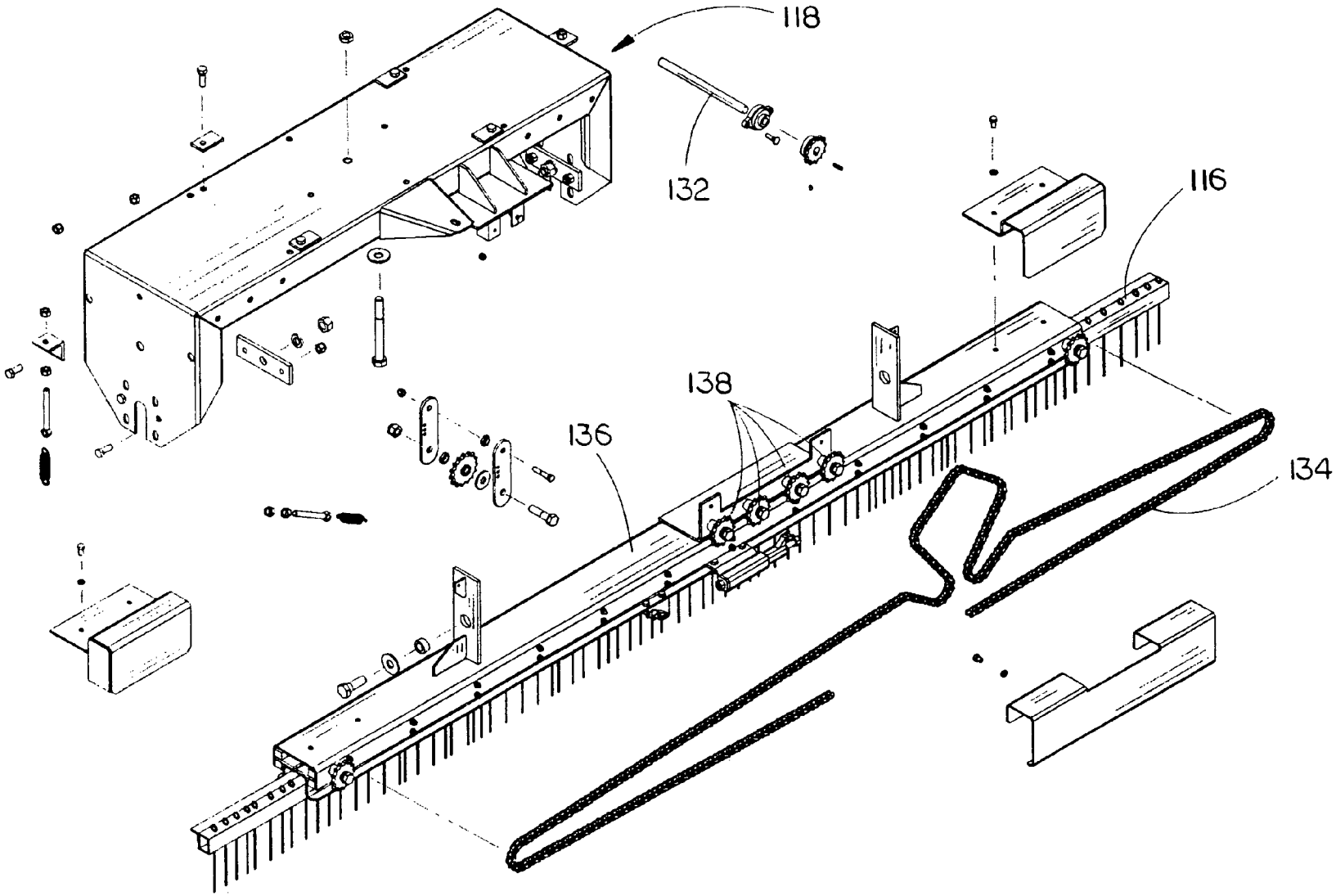
FIG. 15 is an exploded isometric view of the undercarriage assembly illustrated in FIG. 10.
Figure 16:
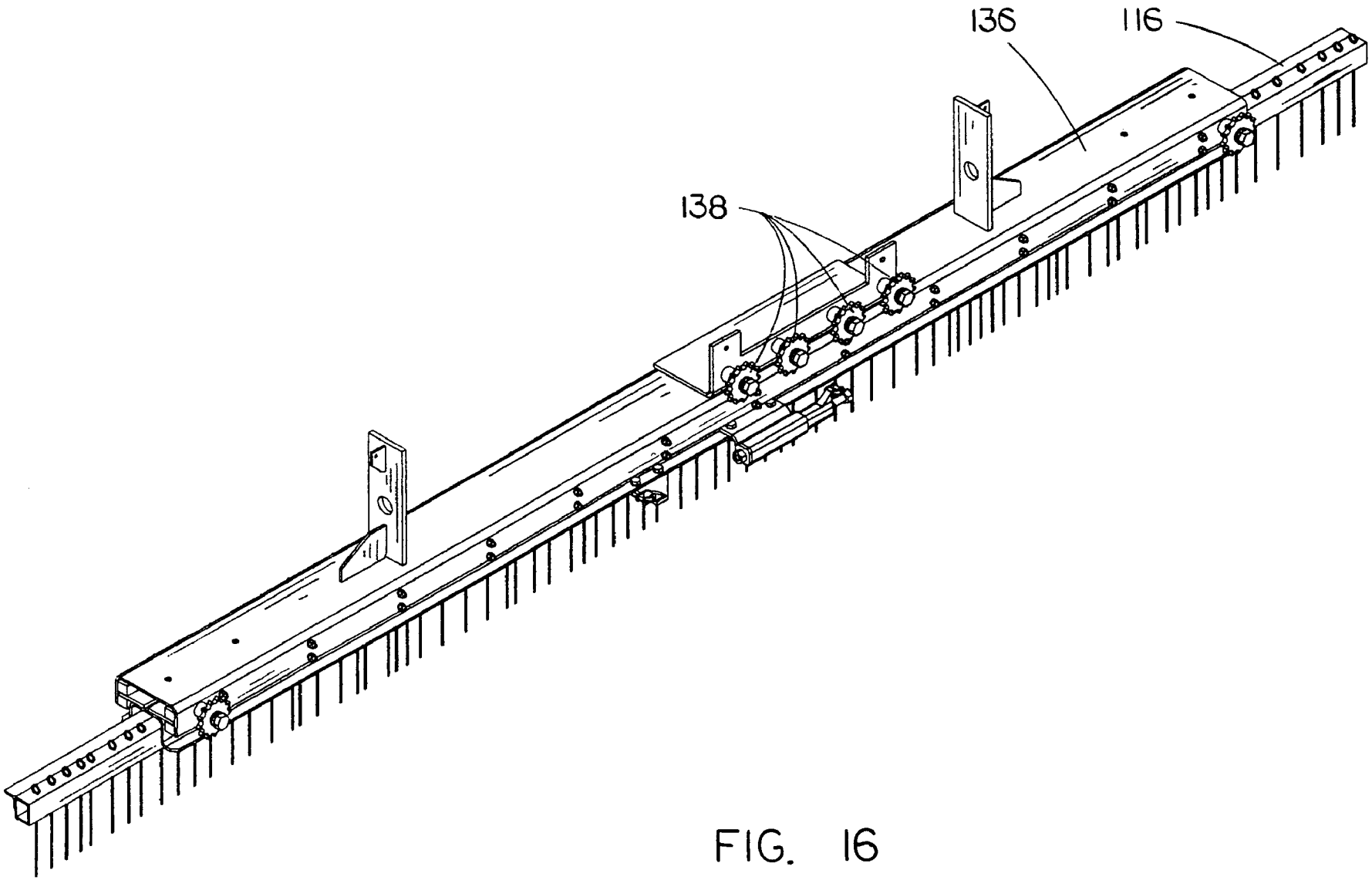
FIG. 16 is an isometric view of the upper broom mount slide assembly and the lower texture broom mount assembly illustrated in FIG. 10.
Figure 17:
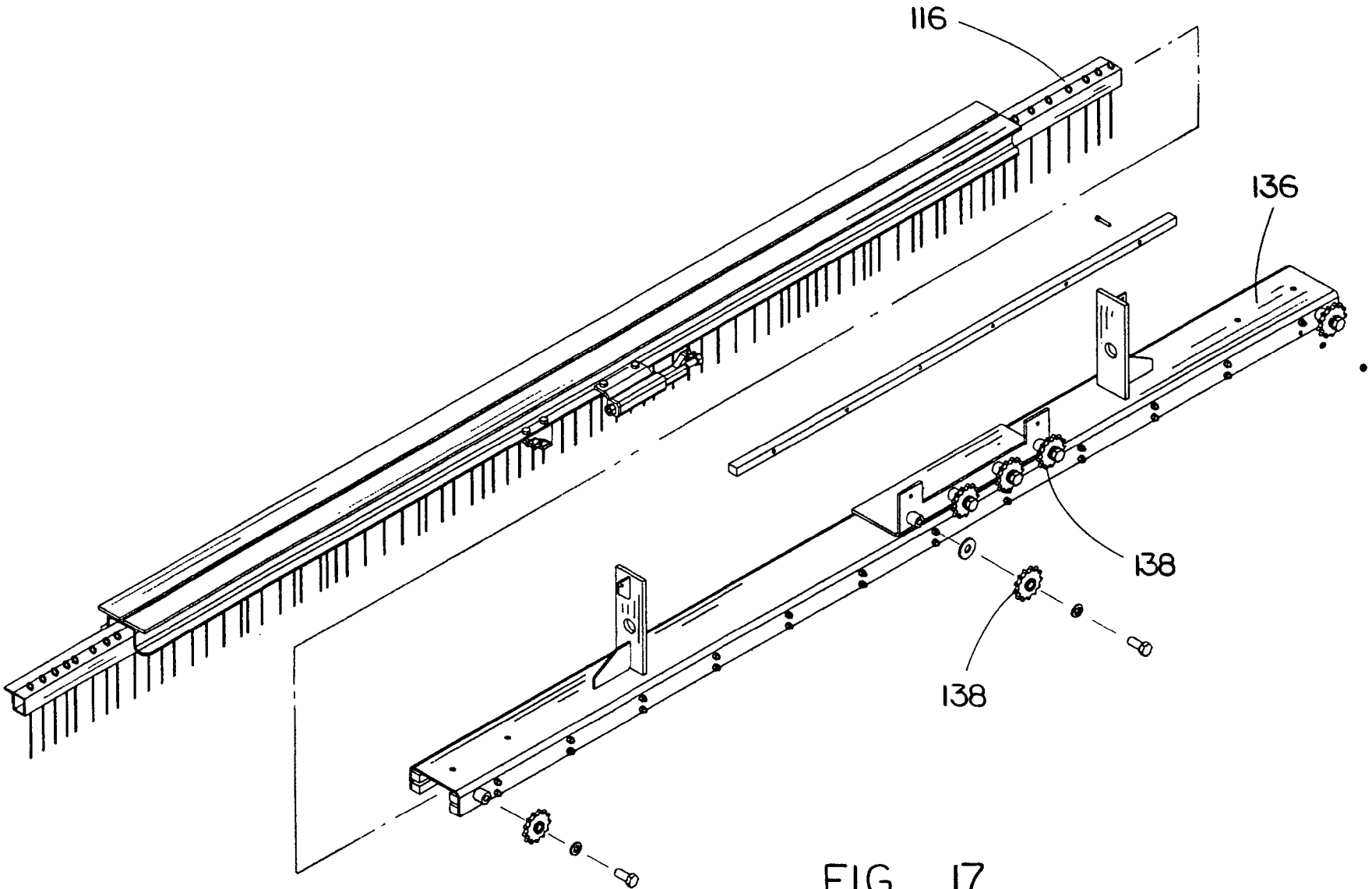
FIG. 17 is an exploded isometric view of the upper broom mount slide assembly and the lower texture broom mount assembly illustrated in FIG. 10.
Figure 18:
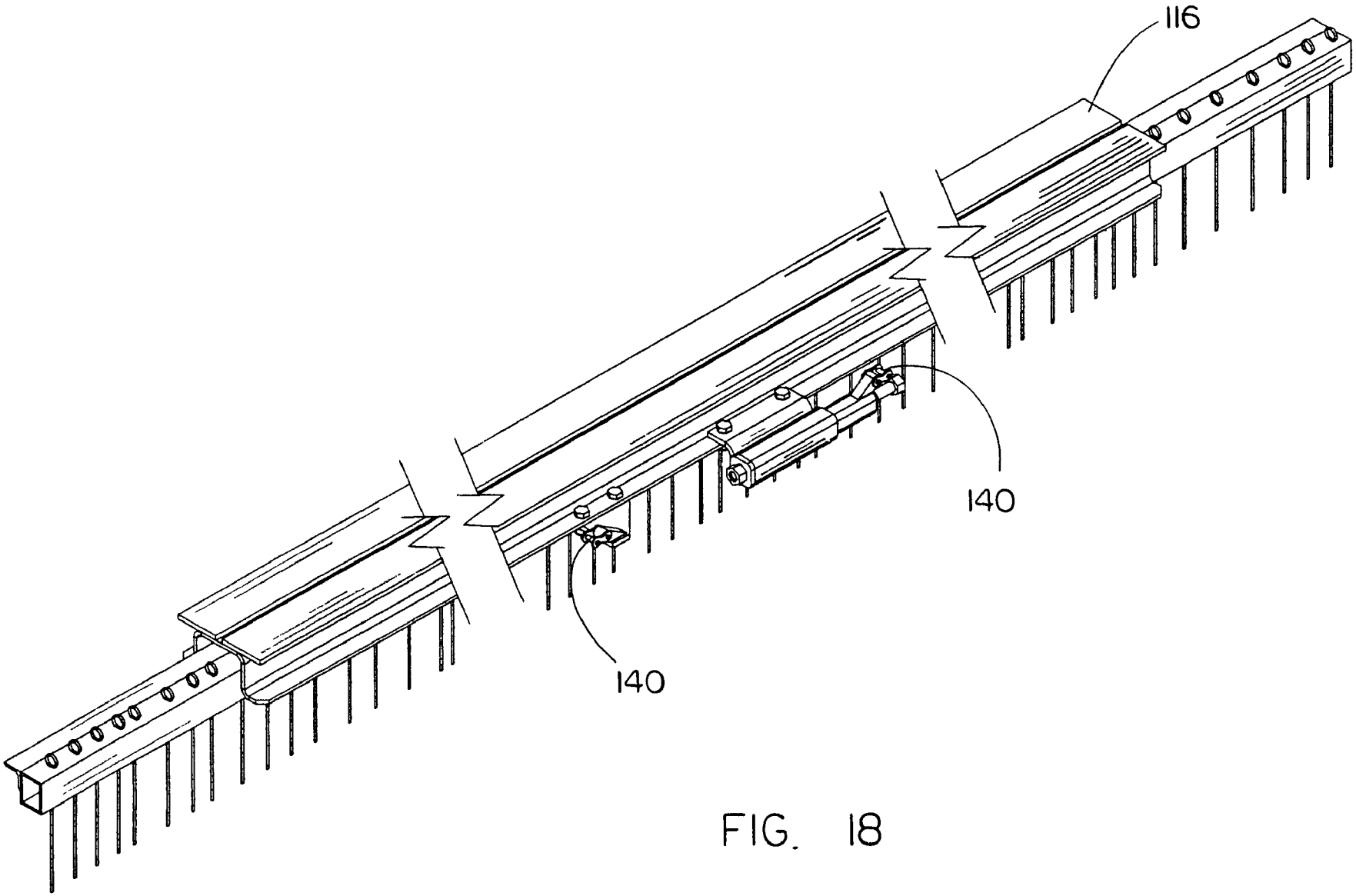
FIG. 18 is a partial isometric view of the lower texture broom mount assembly illustrated in FIG. 10.

Reference will now be made in detail to the presently preferred embodiments of the invention, examples of which are illustrated in the accompanying drawings.

Referring generally now to FIGS. 1 through 18, a machine 100 for texturing a paved road surface 102 on a skew 104 while the paved road surface 102 is in a plastic state is described in accordance with exemplary embodiments of the present invention. The machine 100 includes a bridge rig 106 for spanning the paved road surface 102. In exemplary embodiments, the bridge rig 106 spans the paved road surface 102 in a generally transverse orientation 108 with relation to the generally longitudinal orientation 110 of the paved road surface 102. The generally longitudinal orientation 110 of the paved road surface 102 refers to the direction of travel of the machine 100 (either forward or backward) as it travels along the paved road surface 102 for texturing. The generally transverse orientation 108 of the bridge rig 106 refers to an orientation generally perpendicular to the generally longitudinal orientation 110 of the paved road surface 102 (and to the direction of travel of the machine 100). The machine 100 includes a transverse texturing assembly 112 connected to the bridge rig 106 for texturing the paved road surface 102.

The transverse texturing assembly 112 includes a carriage assembly 114, which is supported by the bridge rig 106 for traveling at least a portion of the span of the bridge rig 106 along its generally transverse orientation 108. The transverse texturing assembly 112 also includes a texturing element 116, which is connected to the carriage assembly 114 for texturing the paved road surface 102 as the carriage assembly 114 moves along the bridge rig 106. For example, in a specific embodiment, the transverse texturing assembly 112 includes an undercarriage assembly 118, which is connected to the carriage assembly 114. In this configuration, the texturing element 116 is translationally coupled with the undercarriage assembly 118 for texturing the paved road surface 102. The texturing element 116 is longitudinally aligned with the paved road surface 102 for traveling in the generally longitudinal orientation 110 of the paved road surface 102 with respect to the carriage assembly 114. Thus, the texturing element 116 is capable of forward and backward movement along the paved road surface 102 in an orientation generally parallel to the direction of travel of the machine 100 as it translates longitudinally with respect to the carriage assembly 114. By coordinating the longitudinal movement of the texturing element 116 with the transverse movement of the carriage assembly 114, the paved road surface 102 is textured on a skew 104 while the frame of the machine 100 remains square to the paved road surface 102.

For example, in order to create a transverse tining pattern (skew pattern) on a 6:1 skew, the longitudinal translation of the texturing element 116 (e.g., forward and backward movement generally parallel to the direction of travel of the machine 100) is coordinated with the transverse travel of the carriage assembly 114 (e.g., leftward or rightward movement generally perpendicular to the direction of travel of the machine 100) to provide about one inch of longitudinal texturing element movement for every six inches of transverse carriage assembly movement. Similarly, in order to achieve a transverse tining pattern on a 4:1 skew, the longitudinal translation of the texturing element 116 is coordinated with the transverse travel of the carriage assembly 114 to provide about one inch of longitudinal texturing element movement for every four inches of transverse carriage assembly movement. It will be appreciated that a number of various skews having different ratios may be achieved with the present invention by adjusting the movement of the texturing element 116 with relation to the movement of the carriage assembly 114.

In exemplary embodiments, the bridge rig 106 supports the transverse texturing assembly 112 along the span of the bridge rig 106 on a path that allows the carriage assembly 114 to attain a stowage position 120 when it reaches the end of the path. For example, when the carriage assembly 114 reaches the leftward most or rightward most end of the span of the bridge rig 106, it is angled upward and away from the paved road surface 102 in the stowage position 120. In this manner, the machine 100 can be moved along the paved road surface 102 with the carriage assembly 114 in the stowage position 120 to texture successive areas of pavement without unduly contacting the paved road surface 102 with the texturing element 116. It is contemplated that the transverse texturing assembly 112 may be removed from contact with the paved road surface 102 in a variety of other ways, including lifted off the surface, rotated about an axis along the bridge rig 106, and the like. For example, in one specific embodiment, the carriage assembly 114 travels a generally linear path along the span of the bridge rig 106, but is capable of rotating the texturing element 116 from a stationary position and lifting the texturing element 116 upward and away from the paved road surface 102.

In exemplary embodiments, the carriage assembly 114 is moved along the span of the bridge rig 106 with hydraulic circuitry. The carriage assembly 114 includes a right angle gear box 122, which is coupled with a stationary timing chain 124 located between the right and left ends of the machine 100 and attached at both ends of the bridge rig 106. One end of the machine 100 has a chain tensioning device. The right angle gear box 122 is coupled with the stationary timing chain 124 via a main driven sprocket 130. The stationary timing chain 124 transmits power to the undercarriage assembly 118 by utilizing the right angle gear box 122, thereby controlling the longitudinal translation of the texturing element 116. For example, in one specific embodiment, the right angle gear box 122 has a 2:1 reduction ratio and is connected to an output drive sprocket 126. The output drive sprocket 126 is then connected to the undercarriage assembly 118 via a second chain 128 coupled with a jack shaft 132. The jack shaft 132 is, in turn, connected with a final drive chain 134, which is coupled with the texturing element 116 for transmitting power to the texturing element 116.

For example, in a specific embodiment, the texturing element 116 is a lower texture broom mount assembly 116 that includes anchor points 140 for the final drive chain 134. One of the anchor points 140 for the final drive chain 134 is adjustable. The undercarriage assembly 118 includes a frame and an upper broom mount slide assembly 136 with chain guide idler sprockets 138 mounted thereto. The final drive chain 134 is guided through the chain guide idler sprockets 138 on the upper broom mount slide assembly 136 and connected to the anchor points 140 on the lower texture broom mount assembly 116. Thus, as the final drive chain 134 receives power from the stationary timing chain 124 via the main driven sprocket 130, the right angle gear box 122, the output drive sprocket 126, the second chain 128, and the jack shaft 132, the lower texture broom mount assembly 116 is shifted front to rear in the upper broom mount slide assembly 136.

It will be appreciated that the direction of skew can be changed by running the stationary timing chain 124 either over or under the main driven sprocket 130 on the carriage assembly 114. Further, it should be noted that additional skew patterns can be accomplished by utilizing a main driven sprocket 130 having more or fewer teeth to achieve the desired skew ratio. Moreover, while the arrangement of the gear box, the sprockets, and the chains illustrated in the accompanying figures is shown with some specificity, it should be apparent that many changes can be made in the arrangement of gear boxes, chains, and sprockets, including the utilization of more and fewer gear boxes, chains, and sprockets, without departing from the scope and intent of the present invention. Further, while the carriage assembly 114 and the undercarriage assembly 118 have been fabricated as separate pieces in the accompanying figures, it will be appreciated that they, and possibly the upper broom mount slide assembly 136, may be of unitary construction without departing from the scope and intent of the present invention.

In the embodiment illustrated in FIGS. 1 through 18, the machine 100 is a texturing/curing machine having a bridge rig 106 including an adjustable width frame 142. For example, in one specific embodiment, the adjustable width frame 142 may be capable of adjusting from a span of about 12 ft. 10 in. to a span of about 56 ft. 10 in. The adjustable width frame 142 is supported by two hydraulically powered, gear-driven crawler tracks 144, which allow the machine 100 to travel along the paved road surface 102. While the machine 100 is illustrated with some specificity in FIGS. 1 through 18 as a texturing/curing machine, it will be appreciated that the transverse texturing assembly 112 may be attached to a variety of other machines, including paving machines, and any other suitable machines for spanning the paved road surface 102. Moreover, while the texturing element 116 is illustrated as a broom including tines, it will be appreciated that other texturing elements may be utilized with the present invention, including random spaced flat tempered spring wire tines, cylindrical tempered spring wire tines, brass wire tines, stainless steel wire tines, plated steel wire tines, soft horsehair bristle brooms, stiff bristle brooms, polystyrene bristle brooms, polypropylene bristle brooms, nylon bristle brooms, African bass fiber brooms, Tampico fiber brooms, Palmyra and Bassine fiber brooms, burlap drag, and/or artificial/synthetic turf drag texturing elements.

Figure 19:
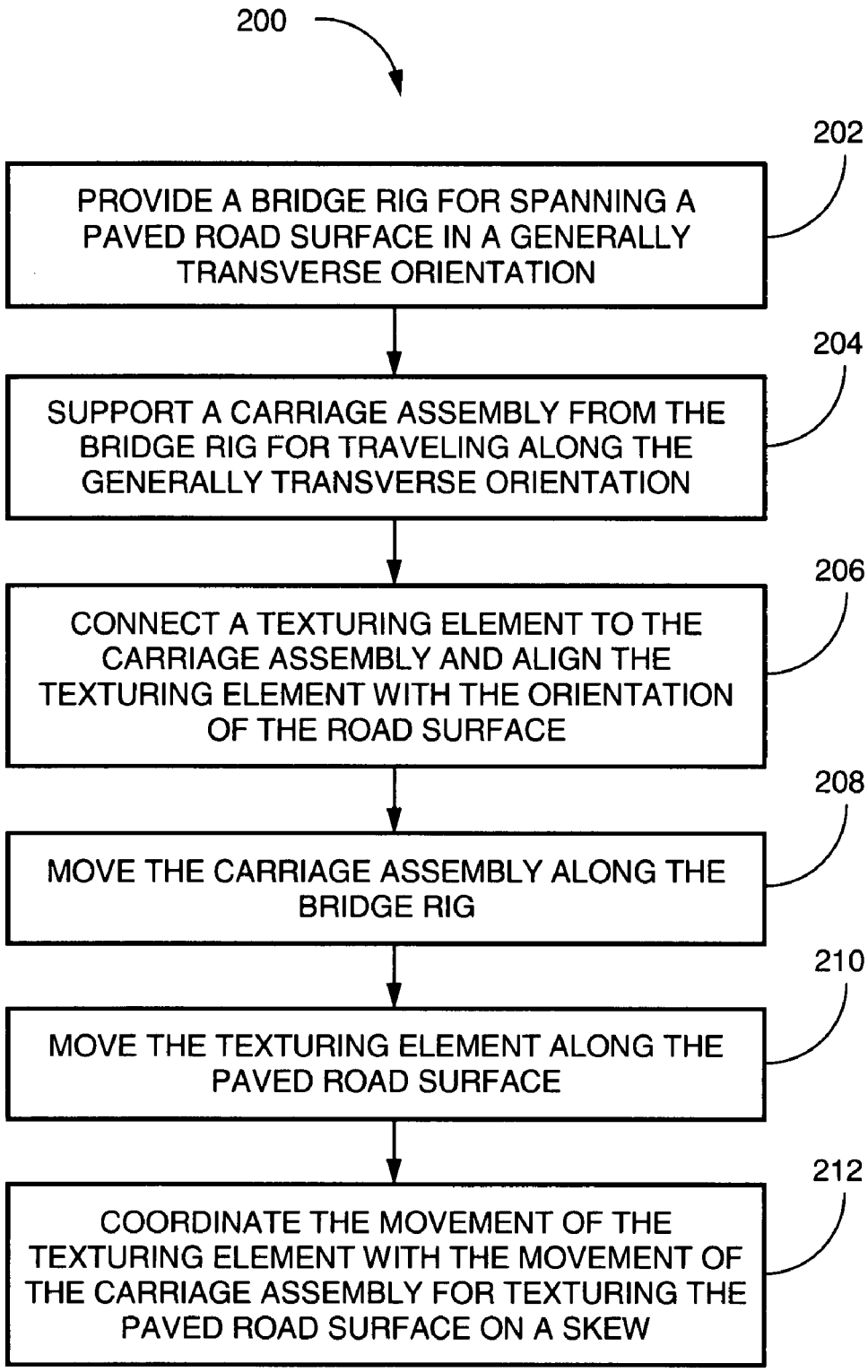
FIG. 19 is a flow diagram illustrating a method for texturing a paved road surface on a skew in accordance with an exemplary embodiment of the present invention.

Referring now to FIG. 19, a method 200 for texturing a paved road surface on a skew is described in accordance with an exemplary embodiment of the present invention. First, a bridge rig for spanning the paved road surface in a generally transverse orientation with relation to the generally longitudinal orientation of the paved road surface is provided, 202. Next, a carriage assembly is supported from the bridge rig for traveling at least a portion of the span of the bridge rig along the generally transverse orientation, 204. A texturing element is connected to the carriage assembly for texturing the paved road surface. The texturing element is longitudinally aligned with the paved road surface for traveling in the generally longitudinal orientation of the paved road surface with respect to the carriage assembly, 206. The carriage assembly is moved along the bridge rig, 208, and the texturing element is moved along the paved road surface, 210. Finally, the movement of the texturing element is coordinated with the movement of the carriage assembly for texturing the paved road surface on a skew, 212.

In the exemplary embodiments, steps of the method 200 may be implemented as sets of instructions or software. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A machine for texturing a paved road surface on a skew while the paved road surface is in a plastic state, the paved road surface having a generally longitudinal orientation, the machine comprising:

a bridge rig for spanning the paved road surface in a generally transverse orientation with relation to the generally longitudinal orientation of the paved road surface;

a carriage assembly supported by the bridge rig for traveling at least a portion of the span of the bridge rig along the generally transverse orientation;

an undercarriage assembly connected to the carriage assembly; and a texturing element translationally coupled with the undercarriage assembly for texturing the paved road surface, the texturing element longitudinally aligned with the paved road surface for traveling in the generally longitudinal orientation of the paved road surface with respect to the carriage assembly, wherein the longitudinal translation of the texturing element is coordinated with the transverse travel of the carriage assembly for texturing the paved road surface on a skew.

2. The machine as claimed in claim 1, wherein the longitudinal translation of the texturing element is coordinated with the transverse travel of the carriage assembly to provide about one inch of longitudinal texturing element movement for between about every four inches and every six inches of transverse carriage assembly movement.

3. The machine as claimed in claim 1, wherein an end of the span of the bridge rig includes a stowage position for the carriage assembly.

4. The machine as claimed in claim 1, wherein the texturing element comprises at least one of a broom texturing element, a random spaced flat tempered spring wire tine texturing element, a cylindrical tempered spring wire tine texturing element, a brass wire tine texturing element, a stainless steel wire tine texturing element, a plated steel wire tine texturing element, a soft horsehair bristle broom texturing element, a stiff bristle broom texturing element, a polystyrene bristle broom texturing element, a polypropylene bristle broom texturing element, a nylon bristle broom texturing element, an African bass fiber broom texturing element, a Tampico fiber broom texturing element, a Palmyra and Bassine fiber broom texturing element, a burlap drag texturing element, and an artificial/synthetic turf drag texturing element.

5. The machine as claimed in claim 1, further comprising a stationary timing chain attached at both ends of the bridge rig for transmitting power to the undercarriage assembly and controlling the longitudinal translation of the texturing element.

6. The machine as claimed in claim 5, wherein the carriage assembly includes a right angle gear box for connecting with the stationary timing chain and transmitting power to the undercarriage assembly for controlling the longitudinal translation of the texturing element.

7. The machine as claimed in claim 6, wherein the undercarriage assembly includes a final drive chain and the right angle gear box is connected with the final drive chain via a jack shaft.

8. A method for texturing a paved road surface on a skew while the paved road surface is in a plastic state, the paved road surface having a generally longitudinal orientation, the method comprising:

providing a bridge rig for spanning the paved road surface in a generally transverse orientation with relation to the generally longitudinal orientation of the paved road surface;

supporting a carriage assembly from the bridge rig, the carriage assembly for traveling at least a portion of the span of the bridge rig along the generally transverse orientation;

connecting a texturing element to the carriage assembly for texturing the paved road surface, the texturing element longitudinally aligned with the paved road surface for traveling in the generally longitudinal orientation of the paved road surface with respect to the carriage assembly;

moving the carriage assembly along the bridge rig;

moving the texturing element along the paved road surface; and coordinating the movement of the texturing element with the movement of the carriage assembly for texturing the paved road surface on a skew.

9. The method as claimed in claim 8, wherein the step of connecting the texturing element to the carriage assembly comprises connecting an undercarriage assembly to the carriage assembly and translationally coupling the texturing element with the undercarriage assembly.

10. The method as claimed in claim 8, wherein the step of coordinating the movement of the texturing element with the movement of the carriage assembly comprises providing about one inch of texturing element movement for between about every four inches and every six inches of carriage assembly movement.

11. The method as claimed in claim 8, further comprising stowing the carriage assembly when it reaches an end of the span of the bridge rig.

12. The method as claimed in claim 8, wherein the step of coordinating the movement of the texturing element with the movement of the carriage assembly comprises utilizing a stationary timing chain attached at both ends of the bridge rig to coordinate the movement of the texturing element with the movement of the carriage assembly.

13. The method as claimed in claim 12, further comprising connecting the stationary timing chain to a right angle gear box included with the carriage assembly for controlling the longitudinal translation of the texturing element.

14. The method as claimed in claim 13, further comprising connecting the right angle gear box with a final drive chain included with the undercarriage assembly via a jack shaft.

15. A transverse texturing assembly for texturing a paved road surface on a skew while the paved road surface is in a plastic state, the transverse texturing assembly for connecting to a bridge rig spanning the paved road surface in a generally transverse orientation with relation to a generally longitudinal orientation of the paved road surface, the transverse texturing assembly comprising:

a carriage assembly supportable by the bridge rig for traveling at least a portion of the span of the bridge rig along the generally transverse orientation;

an undercarriage assembly connected to the carriage assembly; and a texturing element translationally coupled with the undercarriage assembly for texturing the paved road surface, the texturing element longitudinally aligned with the paved road surface for traveling in the generally longitudinal orientation of the paved road surface with respect to the carriage assembly, wherein the longitudinal translation of the texturing element is coordinated with the transverse travel of the carriage assembly for texturing the paved road surface on a skew.

16. The transverse texturing assembly as claimed in claim 15, wherein the longitudinal translation of the texturing element is coordinated with the transverse travel of the carriage assembly to provide about one inch of longitudinal texturing element movement for between about every four inches and every six inches of transverse carriage assembly movement.

17. The transverse texturing assembly as claimed in claim 15, wherein the texturing element comprises at least one of a broom texturing element, a random spaced flat tempered spring wire tine texturing element, a cylindrical tempered spring wire tine texturing element, a brass wire tine texturing element, a stainless steel wire tine texturing element, a plated steel wire tine texturing element, a soft horsehair bristle broom texturing element, a stiff bristle broom texturing element, a polystyrene bristle broom texturing element, a polypropylene bristle broom texturing element, a nylon bristle broom texturing element, an African bass fiber broom texturing element, a Tampico fiber broom texturing element, a Palmyra and Bassine fiber broom texturing element, a burlap drag texturing element, and an artificial/synthetic turf drag texturing element.

18. The transverse texturing assembly as claimed in claim 15, wherein the bridge rig includes a stationary timing chain, and the transverse texturing assembly is connectable to the stationary timing chain for transmitting power to the undercarriage assembly and controlling the longitudinal translation of the texturing element.

19. The transverse texturing assembly as claimed in claim 18, wherein the carriage assembly includes a right angle gear box for connecting with the stationary timing chain and transmitting power to the undercarriage assembly for controlling the longitudinal translation of the texturing element.

20. The transverse texturing assembly as claimed in claim 19, wherein the undercarriage assembly includes a final drive chain and the right angle gear box is connected with the final drive chain via a jack shaft.

* * * * *